US006095606A

United States Patent [19]

Opsvik

[11] Patent Number: 6,095,606

[45] Date of Patent: Aug. 1, 2000

[54] ADJUSTING DEVICE FOR CHAIRS

[75] Inventor: Peter Opsvik, Oslo, Norway

[73] Assignee: Peter Opsvik AS, Oslo, Norway

[21] Appl. No.: 09/091,351

[22] PCT Filed: Dec. 18, 1996

[86] PCT No.: PCT/NO96/00292

§ 371 Date: Jul. 10, 1998

§ 102(e) Date: Jul. 10, 1998

[87] PCT Pub. No.: WO97/22282

PCT Pub. Date: Jun. 26, 1997

[30] Foreign Application Priority Data

Dec. 18, 1995 [NO] Norway ..... 955141

[51] Int. Cl.[7] ..... A47C 1/06

[52] U.S. Cl. ..... 297/340; 297/311; 297/353

[58] Field of Search ..... 297/311, 340, 297/353

[56] References Cited

U.S. PATENT DOCUMENTS

| | | | |
|---|---|---|---|
| 2,509,102 | 5/1950 | Kuebler . | |
| 4,854,641 | 8/1989 | Reinemann et al. | 297/345 X |
| 5,007,678 | 4/1991 | DeKraker | 297/353 |
| 5,131,717 | 7/1992 | Kaminiski et al. | 297/316 X |
| 5,193,880 | 3/1993 | Keusch et al. | 297/353 X |
| 5,354,120 | 10/1994 | Volkle | 297/301 X |
| 5,486,035 | 1/1996 | Koepke et al. | 297/320 X |
| 5,695,250 | 12/1997 | Lin | 297/353 X |
| 5,860,701 | 1/1999 | Jungjohann et al. | 297/316 X |
| 5,868,468 | 2/1999 | Wang | 297/320 X |

FOREIGN PATENT DOCUMENTS

| | | | |
|---|---|---|---|
| 63860 | 11/1982 | European Pat. Off. | 297/340 |
| 0539733 | 5/1993 | European Pat. Off. . | |
| 4317609 | 12/1994 | Germany | 297/353 |
| 2125284 | 3/1984 | United Kingdom | 297/340 |
| 2273240 | 6/1994 | United Kingdom . | |

*Primary Examiner*—Peter M. Cuomo
*Assistant Examiner*—Brian H. Buck
*Attorney, Agent, or Firm*—Watson Cole Grindle Watson, P.L.L.C.

[57] ABSTRACT

An adjustable chair that includes a frame supporting a seat portion. The frame also supports a member on which a back portion is mounted. The seat portion is synchronously moveable with the back portion such that as the seat portion moves forwardly the back portion moves upwardly and as the seat portion moves rearwardly the back portion moves downwardly. The mechanism effecting this movement includes a feature allowing the independent movement of the back portion or the seat portion.

10 Claims, 7 Drawing Sheets

ADJUSTING DEVICE FOR CHAIRS

Figure 1:
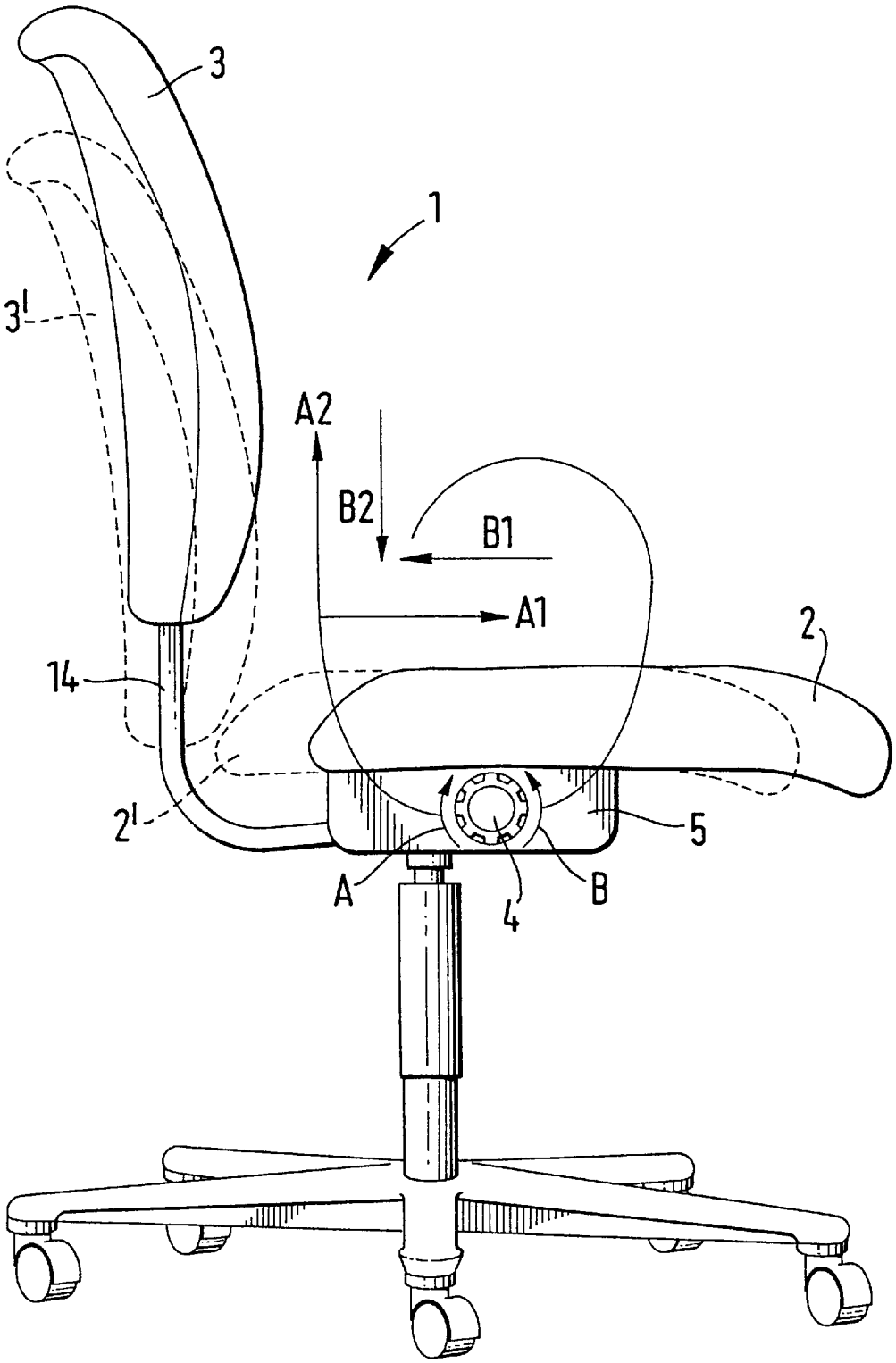

The invention concerns an adjusting device for chairs, wherein the seat portion and back portion in their approximately horizontal and vertical direction respectively are movable by means of adjusting mechanisms for synchronous movement by means of a common operating body.

A device of this type is known from EP-A-0539733. The chair described in this publication has a moveable seat portion which when depressed is moved downwardly and forwardly and thereby causes a lowering of the back portion of the chair in order to provide a more convenient sitting position.

The requirements for the design of chairs, and especially work and office chairs, are becoming increasingly stringent with regard to the correct adjustment of the chair, i.e. the individual adaptation to the user in order to achieve a correct and comfortable sitting position. This requirement is important since such chairs are used over a long period of time, with the result that an incorrect adjustment feels uncomfortable and leads to harmful sitting positions.

An increasing number of adjusting mechanisms for chairs have therefore been developed, which permit adjustment both of the back in the height direction and the seat portion forwards and backwards, thus enabling the chair to be adapted to the person's individual body size. Tilting chairs require adjustment of the spring resistance both for backward tilt and forward tilt. In addition further adjustments can be made both of sitting angles, seat heights, armrest heights, width between armrests, etc., with the result that it can often be a problem for the user to understand and operate the correct levers in order to obtain the required position. The result of this is that, after originally having found an approximately suitable position, the user often does not perform the further adjustments. With so many adjustment levers and wheels (one chair advertises over 20), the task of adjusting the chair can appear so complicated that the user does not even attempt to adjust it to his requirements, and to his size and weight.

There is therefore a requirement to simplify the adjustment, while still achieving the best possible functionality and preferably also means for resisting tilting.

The object of the present invention is to provide an adjusting device which permits such a simple adjustment. Thereby the size of the chairbody shall be adjusted to a depth to the size of the user.

This is achieved with an adjusting device of the type mentioned in the introduction, which is characterized by the features which are indicated in the patent claims.

In the invention the size of the chair body is adjusted to adapt to the size of the user. The basis for the invention is that most adjustments preferably should be capable of implementation with a simple adjusting mechanism, preferably a lever or a wheel. By turning such a wheel or moving such a lever it should therefore be possible to perform basic adjustments which will provide satisfactory functionality for most people. The parts move simultaneously in relation to one another in a "normal relationship". This adjustment, which automatically and simultaneously will adjust both the seat portion and the back portion, is based on the fact that large people require a large chair body, while a correspondingly smaller chair body is best for smaller people. The adjustment possibilities for the backrest and the seat portion have therefore been linked, these two main components of the chair either being pushed from each other or drawn towards each either by a simple rotating movement of the adjusting wheel or lever. Thus, by means of a simple hand maneuver, the user will be able to perform a principal adjustment of the chair (both of seat depth and backrest height). It is essential that both parts of the chair should move and not only the backrest, since the chair body's tilting point should be located directly below the body weight whether the user is small or large. It will be possible to achieve the same "normal relationship" displacement between these parts by locking the seat and pushing the backrest obliquely backwards and upwards, but in this case the body weight in relation to the chair body's tilting point will be wrong for one half of the body size. The term "normal relationship" should be understood to mean that the chair's functions are arranged so as to move simultaneously in a certain relationship to one another, thus providing satisfactory conditions for different body sizes.

Even though this kind of automatic adjustment where the back portion and the seat portion are pushed synchronously from each other, or drawn towards each other will be adequate for most people, nevertheless it is desirable to also be able to adapt the chair to, e.g., people with very short legs and a very long upper body, i.e. people who perhaps thus require a short seat surface and a high back.

Thus it is a further object of the invention to provide, in addition to the principal adjustment, the possibility of also being able to perform an individual adjustment of the seat and the back portion respectively. This object is also achieved by features which are indicated in the patent claims.

The individual adjustment is performed in the invention preferably in connection with the back portion and performed manually by means of a lever which influences an engagement mechanism, thereby permitting a free movement of the back portion. A "specially adjusted" chair of this kind in which there is a deviation from the normal relationship between seat depth and back height could be difficult to have normalized for a new user. In order to be able to bring the chair back to a normal relationship, for this purpose there is provided a release device which comes into force during continued operation of the principal adjusting mechanism for the seat portion/back portion and which causes the back portion to be automatically moved back from its special position to the normal position in relation to the seat portion, with the result that the continued operation will take place synchronously between these two parts until someone again employs the release device.

Just as there is a requirement to adjust the chair body's "size" to conform with the user's size, there will also be a requirement for a corresponding adjustment of the seat portion's suspension and the seat/chair body's tilting resistance respectively. For this purpose the invention can be combined with the device which is described in the simultaneous Norwegian patent application no. 955140 according to which seat/back portion's tilting resistance means are adjusted in step with the general adjustment of the chair, with the result that when the seat surface is extended (and the backrest raised) the tilting resistance is increased, and will decrease when the seat surface is shortened (and the backrest lowered). This adjustment can also be adapted individually in a special embodiment and is returned to the normal relationship when the principal operating body is employed.

The different adjusting mechanisms are preferably designed as mechanical devices, but they can also be designed to act via hydraulic or pneumatic cylinders. In special embodiments the adjusting mechanisms can also be electrically operated. The essential feature of the invention consists in the actual adjustment facility, where several functions alter in a mutually determined relationship—"the normal relationship"—by means of an operating movement. Next, that this mutual relationship can be deviated from in order to satisfy special requirements, but that as soon as the principal operating body is employed the "normal relationship" will be restored.

Figure 2:
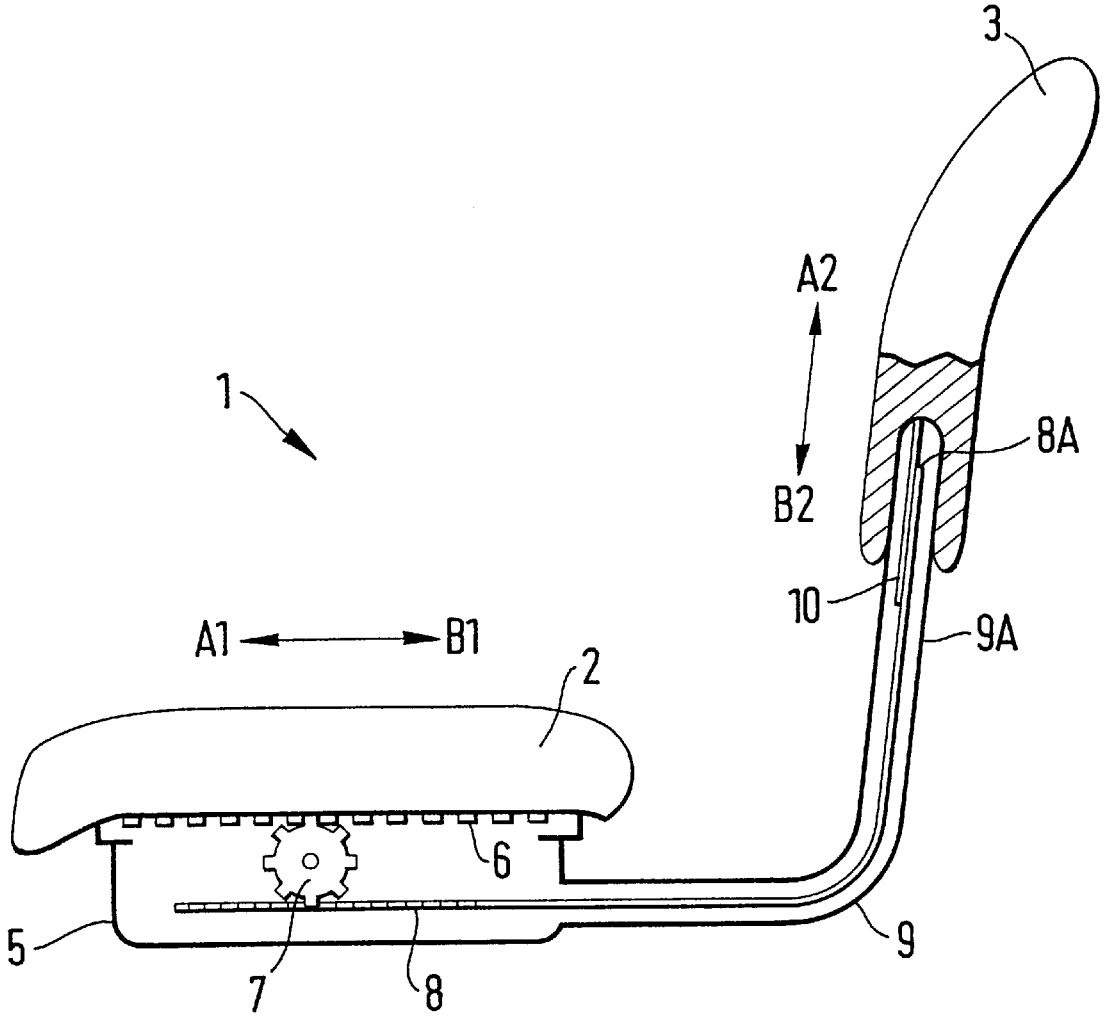
Figure 3:
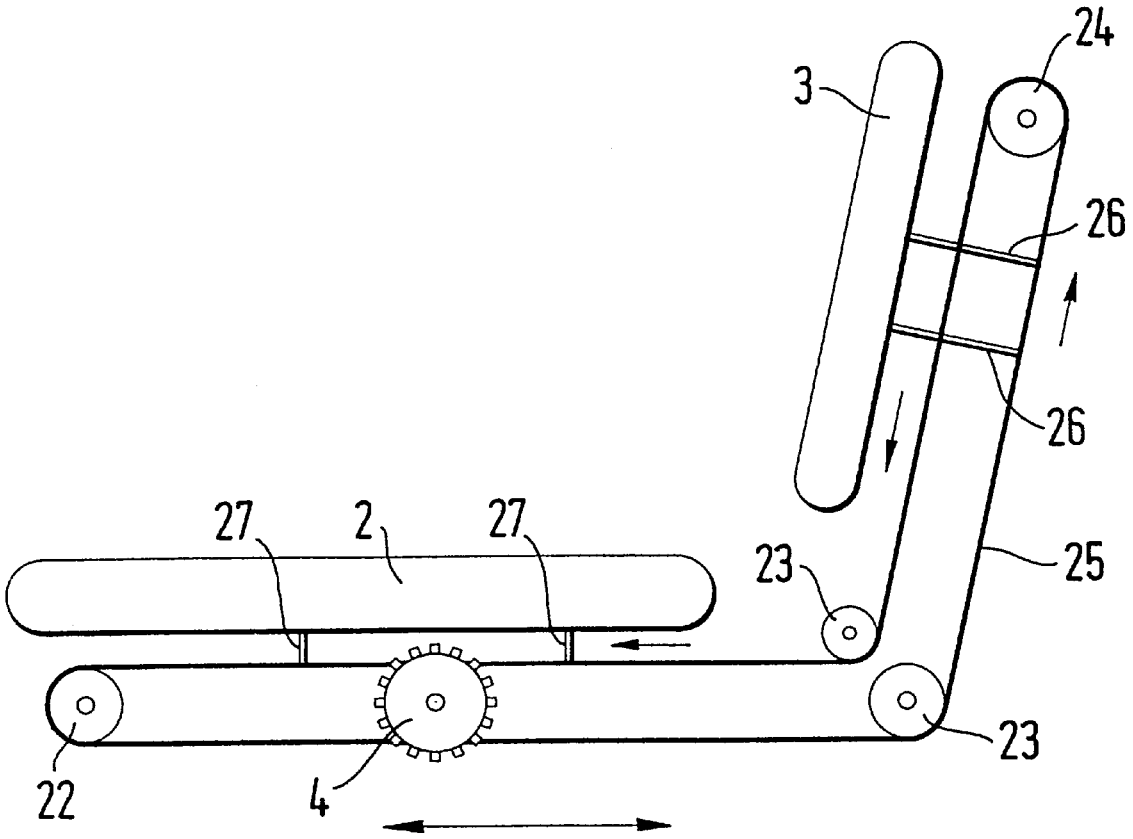
Figure 4:
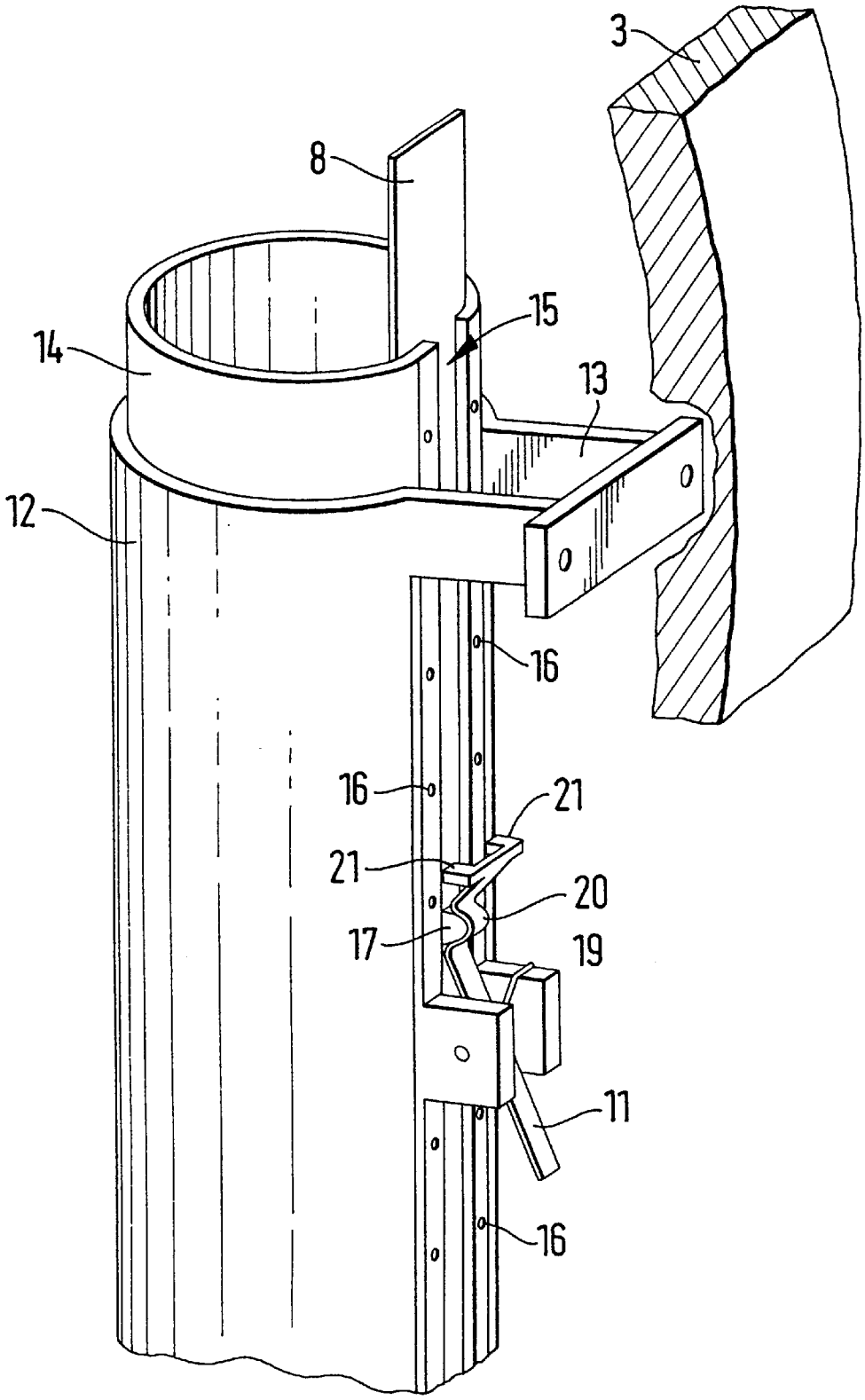
Figure 5:
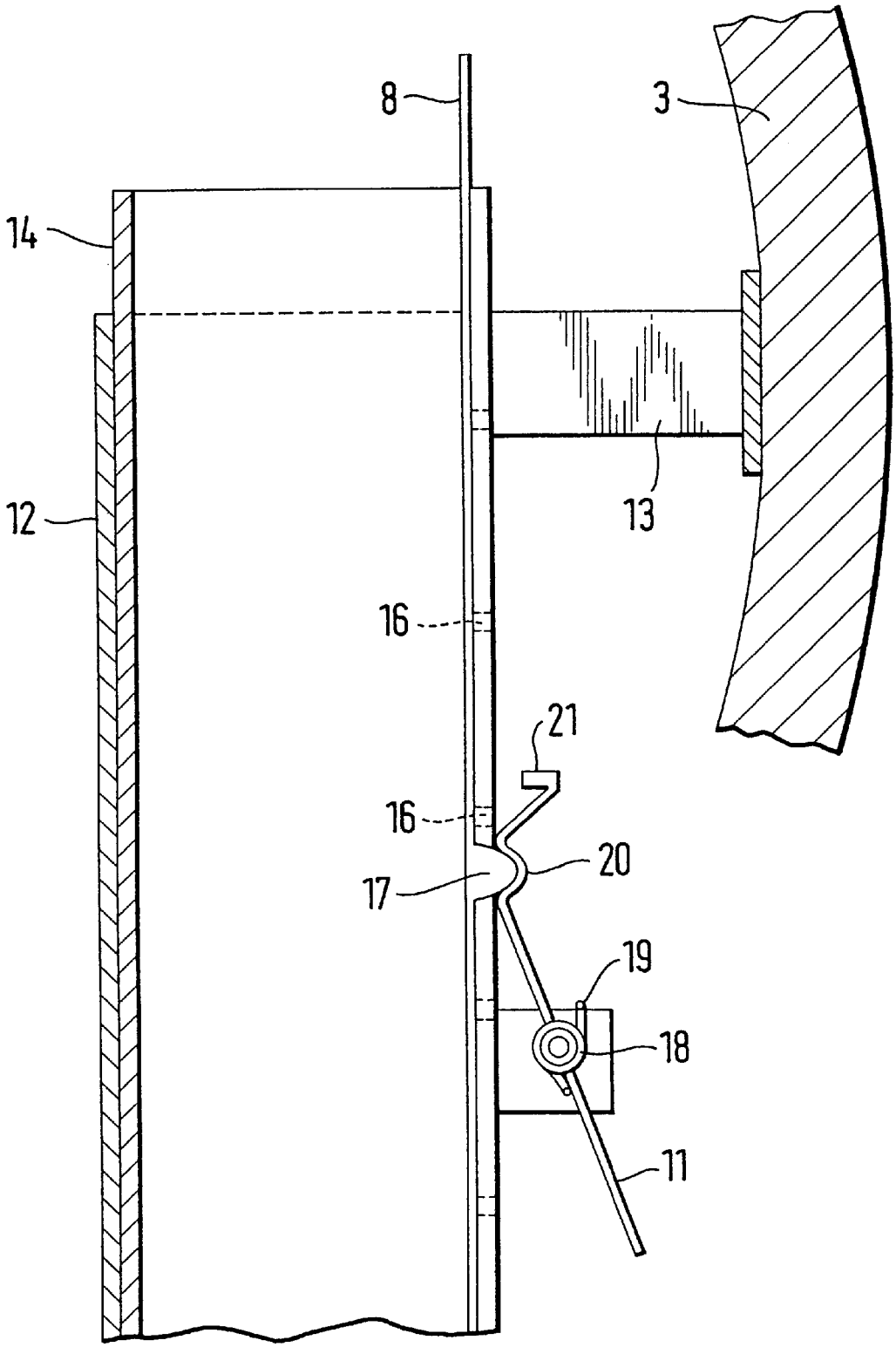
Figure 6:
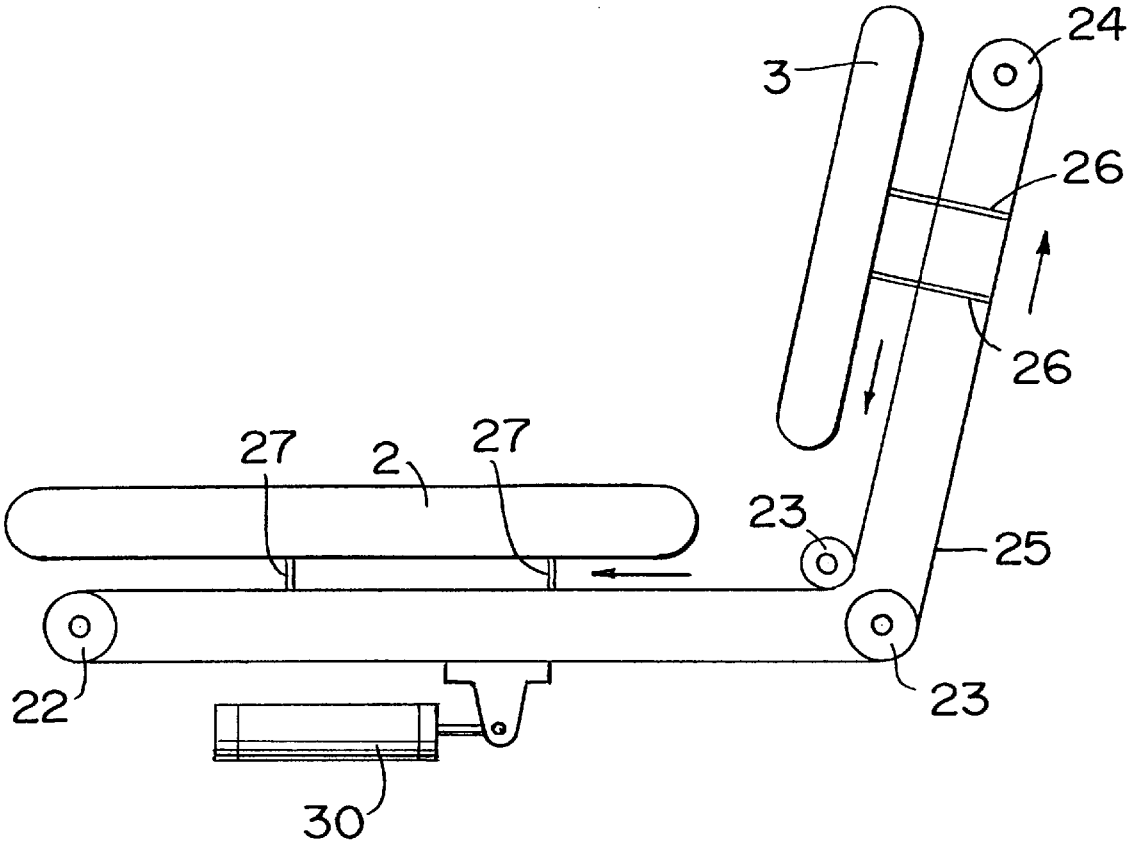
Figure 7:
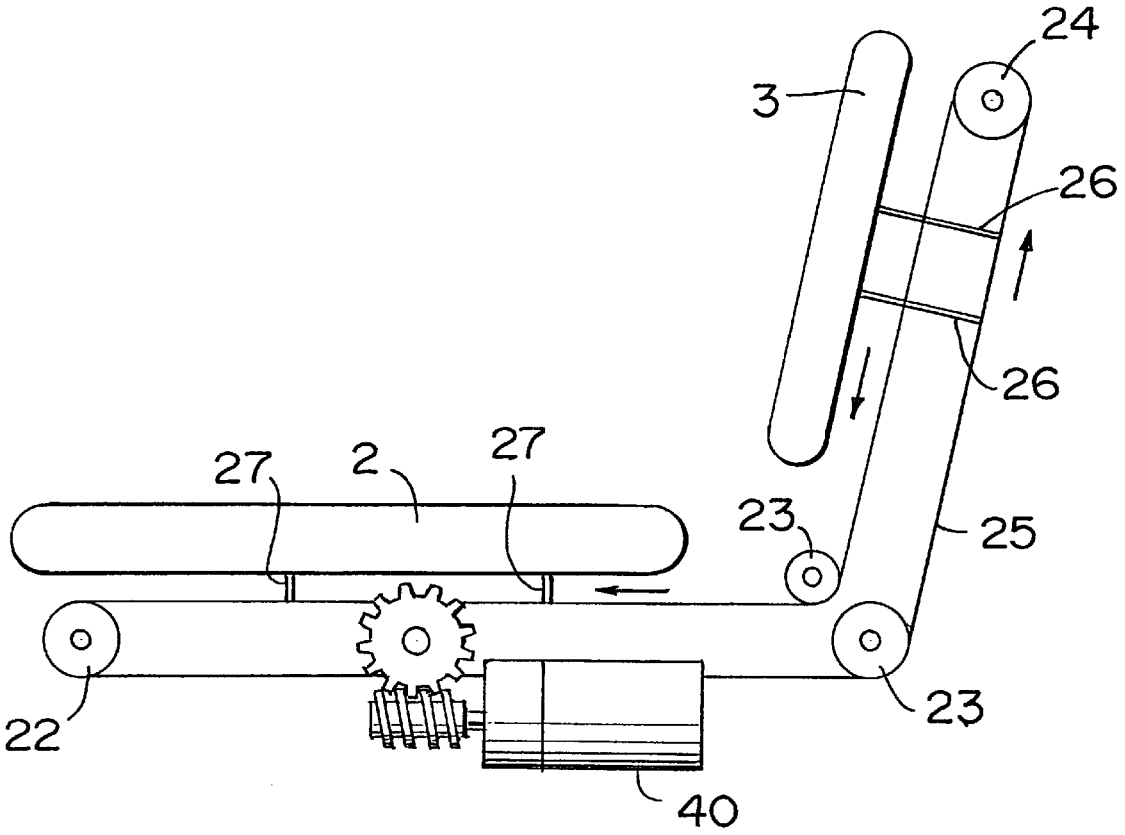

The invention will now be illustrated in more detail by means of an embodiment which is illustrated in the drawing, which shows in a purely schematic form:

FIG. 1 a side view which illustrates the possibilities for movement which are obtained by means of the invention, FIG. 2 a schematic principle drawing for a version where a toothed rack is employed, FIG. 3 a schematic view corresponding to FIG. 2 which illustrates a version with belts, FIG. 4 a partial view in perspective which illustrates the extra adjustment possibility with release device for the chair's back portion, and FIG. 5 a sectional view for more detailed illustration of the version in FIG. 4, FIG. 6 is a schematic view showing the hydraulic or pneumatic connected pressure cylinders of claim 9, FIG. 7 a schematic view showing the electrical mechanism of claim 14.

FIGS. 1 and 2 illustrate a first embodiment of an adjusting device where a chair's seat and back portions are movable in their longitudinal direction and height direction respectively by means of a common adjusting mechanism (operating body).

In FIG. 1 a chair 1 is illustrated which comprises in the known manner a basic frame with a column on which there are mounted a seat portion 2 and a back portion 3 which are illustrated in a position with extended lines and with dotted lines in an alternative second extreme position on these two parts. In the first position the seat portion 2 is pushed as far forward as possible, while the back portion 3 is pushed into its uppermost position. This is achieved by turning the wheel 4 in the direction of the arrow A, thus causing the seat portion 2 to be moved in the direction of the arrow A1, while the back 3 is moved in the direction of the arrow A2. By turning the wheel 4 in the opposite direction, i.e. anticlockwise, as shown by the arrow B, the chair seat 2 will move backwards in the direction of the arrow B1 to an innermost position which is illustrated by dotted lines 2', while at the same time as the wheel is turned in the direction of the arrow B the back portion 3 will be moved downwards in the direction of the arrow B2 to the position 3'.

In FIG. 2 there is a purely schematic illustration of how this movement of the seat portion and the back portion in relation to the chair's frame 5 can be achieved. On the underside of the chair seat 2 there are provided one or more toothed tracks 6 which are engaged with one or more toothed wheels 7 which can be rotated by means of the wheel 4. The toothed wheel 7 is also engaged with an adjusting wire or a steel band 8 provided with holes or teeth, which extends from the area at the frame 5 through a supporting tube 9 for the back 3 to be attached to the said back at its upper section 8A.

By turning the wheel 4, i.e. turning the toothed wheel 7, the chair portion will move, e.g., in the direction which is illustrated by the arrow A1 and the back 3 will move in the upward direction as indicated by the arrow A2. The back 3 is moved upwards by means of the flexible wire or the band 8 which is pushed in the tube 9, thereby raising the back, which is also equipped with, e.g., a telescopic part 10 which can be moved in the upper section 9A of the tube 9.

This design can be varied within wide limits, with other mechanical solutions also being envisaged as well as hydraulic, gas-operated or electrical systems for synchronous movement of the seat portion 2 and the back portion 3. An example of a second embodiment of this kind is schematically illustrated in FIG. 3. In this embodiment too the adjustment is performed by means of a wheel 4, but in this case toothed racks and toothed wheels are replaced by an endless band or a strap which is passed over return rollers 22, 23, 24. The band or the strap which is designated 25 may be a flat steel band, but can also be of another material and it will also be possible to use steel wires. The chair portion is mounted on the upper part of the horizontal part of the band by suitable attachment means 27, which are not illustrated in more detail, while the back portion 3 is attached in a similar fashion by attachment means 26 to the rear part of the band 25. By turning the wheel 4, the same pattern of movement will be obtained as in the previous example. It should be clear that it will also be possible to employ hydraulic or pneumatic aids as shown in FIG. 6, at reference numeral 30, or also electrical operation as shown on FIG. 7. at referemce numeral 40, in order to provide a corresponding pattern of movement.

FIGS. 4 and 5 illustrate how an individual height adjustment or release device can be undertaken for the back portion 3. In this connection it should be pointed out that it will be possible to perform a reversal of the positions of the adjustment means release device without any trouble, so that it will be possible to also employ the adjustment which is described in the following section in connection with the back portion for the seat portion, while the back portion is designed without the possibility for such an individual adjustment. In principle it will only be necessary to have an individual adjustment either of the back portion or of the seat portion.

FIGS. 4 and 5 show a section of the support device for the back with a support tube for the chair back 3, which in this embodiment is designated as sleeve 12. For the individual adjustment an operating arm 11 is employed. The operating arm 11 is rotatably mounted on the sleeve 12 which supports the chair back portion 3. The latter is supported by the upper cross bracket 13. The sleeve 12 is slidably provided on a tube 14 which extends vertically up from the chair frame. This tube 14 is split in the longitudinal direction. On each side of the split 15 a hole 16 is provided in the edges of the tube at regular intervals, hole 16 of one tube edge being located horizontally above hole 16 of the other tube edge, thus creating a vertical row of hole pairs.

In the tube there is provided a band (rod) 8 which supports a single projecton 17 (in the figure the operating arm rests on this projection and it is apparent that the notch or indentation 20 has a shorter depth than the height of the projection). Furthermore, the operating arm 11 is spring loaded in a counterclockwise direction by means of a coil spring 18 one end of which rests on the bracket 19 which supports the arm 11.

When the backrest is to be released from the band 8, the lower end of the arm is pressed in, thus causing the arm to be rotated clockwise. An indentation or notch 20 of the arm is thereby brought out of engagement with the projection 17. The seat back is then moved up or down, whereupon the arm is released. Two hooks 21 at the upper section of the arm can thereby each slip into its hole 16 at the tube edges.

The arm is designed with an inclined plane on either side of the notch in the extension, or region, adjacent the notch. When the seat back is to be returned to normal, the wheel is operated which causes the band and the seat to move. When the projection 17 comes into contact with one of the inclined planes or tilted sections of the arm on one side or the other of the above-mentioned indentation of the arm, the arm is rotated by the projection in the clockwise direction, thus bringing the hooks out of the holes and the projection is inserted into the indentation. When the height of the projection is so great that the hooks thereby cannot touch the band, the seat back is moved up and down while at the same time the seat is moved forwards and backwards, the normal setting for these components having once more been attained.

By means of this mechanism the following advantages are obtained:

a) the chair is easily operated by means of a one-grip handle (many functional objects and tilt resistance means are adjusted simultaneously in a mutually determined "normal relationship", b) many adjustment possibilities for the person who wishes an even more individual adaptation (the normal relationship is interrupted), c) the chair will always return to the normal relationship (between the different functions) when a new user operates the principal operating body.

Many modifications will be possible within the scope of the invention. As mentioned, the mechanisms for seat portion and back portion can be exchanged, the design of the movement mechanisms can be varied and it will be possible for a person skilled in the art to also provide the same pattern of movement by other means than mechanical media, e.g. hydraulic, pneumatic or electrical means. A link arm mechanism can also be employed in which the arms can be retracted/unfolded and where during such manipulation the mechanism is controlled in such a manner that the position of the seat and/or the armrest is adjusted as required. All such embodiments are intended to fall within the scope of the invention. It is also stated above that the device according to the invention can also be combined with an adjusting device for the chair seat's tilting resistance, e.g. of the type which is described in the applicant's NO application 955140. The seat movement which governs the tilting resistance can simultaneously control the position of the back portion. Similarly, an adjustment of the armrests can also be incorporated, with these being adjusted to different heights in relation to the user. An adjusting mechanism of this kind can be designed in a similar manner to the device according to the invention, either as a separate device or combined with the device according to the invention.

What is claimed is:

1. A chair having a front portion and a rear portion, said chair including a seat portion, a back portion, and an adjusting mechanism for adjusting the position of said seat portion and said back portion, said seat portion being supported for movement forwardly and rearwardly of the chair, said back portion being supported for movement upwardly and downwardly relative to the chair, said adjusting mechanism permitting synchronous movement of said seat portion forwardly and said back portion upwardly and also permitting synchronous movement of said seat portion rearwardly and said back portion downwardly, characterized in that for individual adjustment the back portion or the seat portion can be released from the adjusting mechanism.

2. A device according to claim 1, characterized in that the back portion and the seat portion can be released by means of a release device having releasable locking means for connection to the adjusting mechanism.

3. A device according to claim 2, characterized in that the locking means comprise a spring-loaded locking arm with a notch having the same shape as a projection on the mechanism, and that the spring force is directed towards the mechanism to secure the projection in the notch.

4. A device according to claim 3, characterized in that the notch has a shorter depth than the height of the projection, that the end of the arm facing the mechanism has at least one hook or a pair of hooks, and further including in the chair's supporting body a row of holes which is adapted to work together with the pair of hooks.

5. A device according to claim 4, characterized in that the arm adjacent the notch is constructed with an inclined plane on each side of the notch.

6. A chair having a front portion and a rear portion, said chair including a frame, a seat portion supported for linear movement relative to said frame forwardly and rearwardly of the chair, support means carried by said frame, a back portion supported for linear movement relative to said support means upwardly and downwardly of the chair, and an adjusting mechanism for adjusting the position of said seat portion and said back portion, so that when said seat portion moves forwardly of the chair said back portion simultaneously moves upwardly of the chair, and further so that when said seat portion moves rearwardly of the chair said back portion moves downwardly of the chair.

7. A device according to claim 6, characterized in that the adjusting mechanism comprises a toothed rack and band connected by a joint toothed wheel.

8. A device according to claim 6, characterized in that the adjusting mechanism includes hydraulic or pneumatic connected pressure cylinders for permitting synchronous operation of said seat portion and said back portion.

9. A device according to claim 6, characterized in that the adjusting mechanism includes an endless belt, where the seat portion and the back portion are attached to an upper track and a rear track of the belt respectively.

10. A device according to claim 6, characterized in that the adjusting mechanism includes an electrical mechanism for permitting synchronous operation of said seat portion and said back portion.

* * * * *